US005649607A

United States Patent [19]

Chang et al.

[11] Patent Number: 5,649,607

[45] Date of Patent: Jul. 22, 1997

[54] ESCAPE ASSEMBLY

[76] Inventors: Wei-Chen Chang; Chih-Hsiang Liu, both of 58, Ma Yuan West St., Taichung, Taiwan

[21] Appl. No.: 653,423

[22] Filed: May 24, 1996

[51] Int. Cl.[6] ..... A62B 1/00; A62B 1/02

[52] U.S. Cl. ..... 182/82; 182/36; 182/37; 182/6

[58] Field of Search ..... 182/36, 37, 82, 182/6, 7

[56] References Cited

U.S. PATENT DOCUMENTS

| | | | |
|---|---|---|---|
| 4,406,349 | 9/1983 | Vilchek | 182/82 X |
| 4,466,507 | 8/1984 | Itano | 182/82 X |
| 4,499,966 | 2/1985 | Milne et al. | 182/82 X |

*Primary Examiner*—Alvin C. Chin-Shue
*Assistant Examiner*—Long Dinh Phan

[57] ABSTRACT

An escape assembly has two rows of parallel slide frames positioned on an outer wall. A curved slip frame connects to a last slide frame of each row of parallel slide frames. A slide rail connects to each slide frame. Each slide frames has an H-shaped middle frame connecting to two U-shaped side frames. A slide way is formed in the middle frame. A slide passage is formed between two side frames. The middle frame has two positioning plates. Each side frame has spaced retarding blocks therein. The side frame has a notch thereon. One end of the slide rail is fastened on the side frame. The escape device has a transverse rod, two triangular blocks, two wheels, two parallel longitudinal belts, two loops and a transverse belt with a fastening device thereon. Each end of the transverse rod has a wheel abutting a triangular block. Two rings are disposed beneath the transverse rod. Each ring connects to a longitudinal belt. A loop is disposed at an end of each longitudinal belt. A transverse belt connects two longitudinal belts. Each wheel is inserted in the slide rail.

1 Claim, 7 Drawing Sheets

ESCAPE ASSEMBLY

BACKGROUND OF THE INVENTION

The invention relates to an escape assembly with an escape device and an escape slide. More particularly, the invention relates to an escape assembly for skyscraper fire escapement.

Most conventional fire escape equipments are not suitable for skyscrapers. The conventional fire escape equipments are designed for a building less than ten floors. Most conventional fire escape equipments can receive one person only. The conventional fire escape equipment should reach the ground first, and then the equipment can ascend to the predetermined floor again. However, it consumes too much time to descend and ascend the equipment over and over again. The users of the conventional fire escape equipment may not have enough time to wait for the fire escape equipment to ascend. The user may have less than three minutes to run away. If the building is burned furiously, the user may have only one minute to escape. Most conventional fire escape equipments cannot rescue the users within one minute.

SUMMARY OF THE INVENTION

An object of the invention is to provide an escape assembly for skyscrapers.

Another object of the invention is to provide an escape assembly for rescuing the users in very short time.

Accordingly, an escape assembly comprises two rows of parallel slide frames positioned on an outer wall longitudinally. A curved slip frame connects to each last slide frame of each row of parallel slide frames. A generally C-shaped slide rail connects to each slide frame transversely. Each of the slide frames has an H-shaped middle frame connecting to two U-shaped side frames. A slide way is formed in the middle frame. A slide passage is formed between the corresponding side frames. The middle frame has two parallel positioning plates. Each of the side frames has a plurality of spaced retarding blocks therein. Each of the positioning plates has a plurality of spaced positioning holes thereon. Each of the slide frames is positioned by at least a positioning seat. The positioning seat has a hollow lug at one end and two round holes at the opposite end of the positioning seat. The hollow lug is inserted in the spacing between two parallel positioning plates and fastened by a fastener. The positioning seat is fastened on the outer wall. One of the two side frames has a notch thereon. Two hinges are disposed at the back of the side frame adjacent to the notch. Two angle plates are disposed at one end of the slide rail. The angle plates and the corresponding hinges are fastened together, respectively. The curved slip frame has a blocking plate abutting a rubber pad at a distal end of the curved slip frame. The curved slip frame has an H-shaped intermediate frame connecting to two U-shaped lateral frames. A plurality of grooves are formed along two inner side peripheries of the intermediate frame. An elastic plate is disposed in the corresponding groove. A slip way is formed in the intermediate frame and a slip passage is formed between the corresponding lateral frames. The intermediate frame has two parallel plates. The escape device has a transverse rod, two triangular blocks, two wheels, two parallel longitudinal belts, two loops and a transverse belt with a fastening device thereon. Each end of the transverse rod has a wheel abutting a triangular block. Two rings are disposed beneath the transverse rod. Each ring connects to a longitudinal belt. A loop is disposed at a distal end of each longitudinal belt. A transverse belt connects two longitudinal belts. Each wheel of the escape device is inserted in the slide rail via an opening of the slide rail. The wheels are descended along the corresponding slide ways. The triangular blocks are descended along the corresponding slide passages.

DETAILED DESCRIPTION OF THE INVENTION

Figure 1:
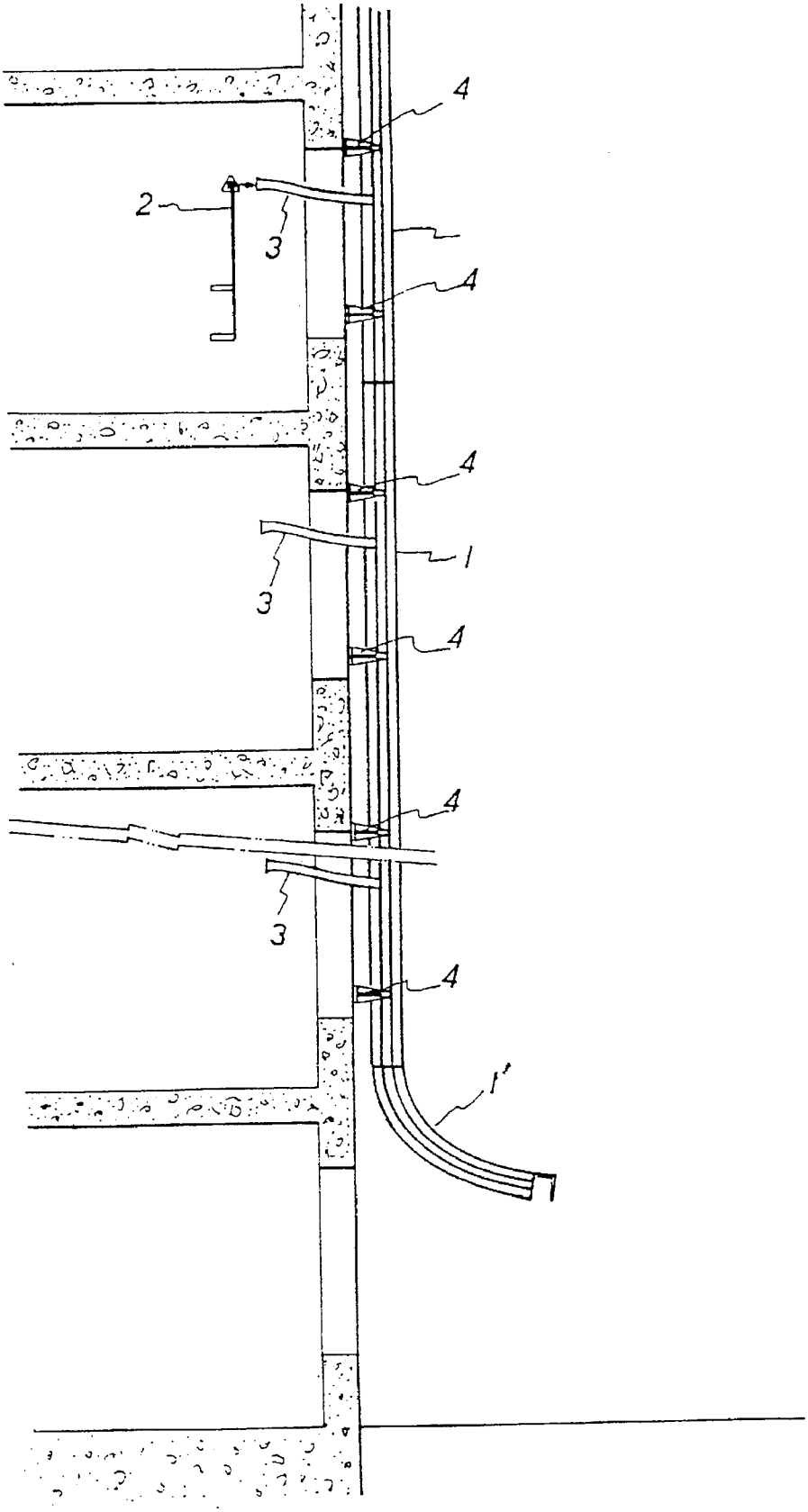
FIG. 1 is a partially elevational view of an escape assembly of a preferred embodiment in accordance with the invention.
Figure 2:
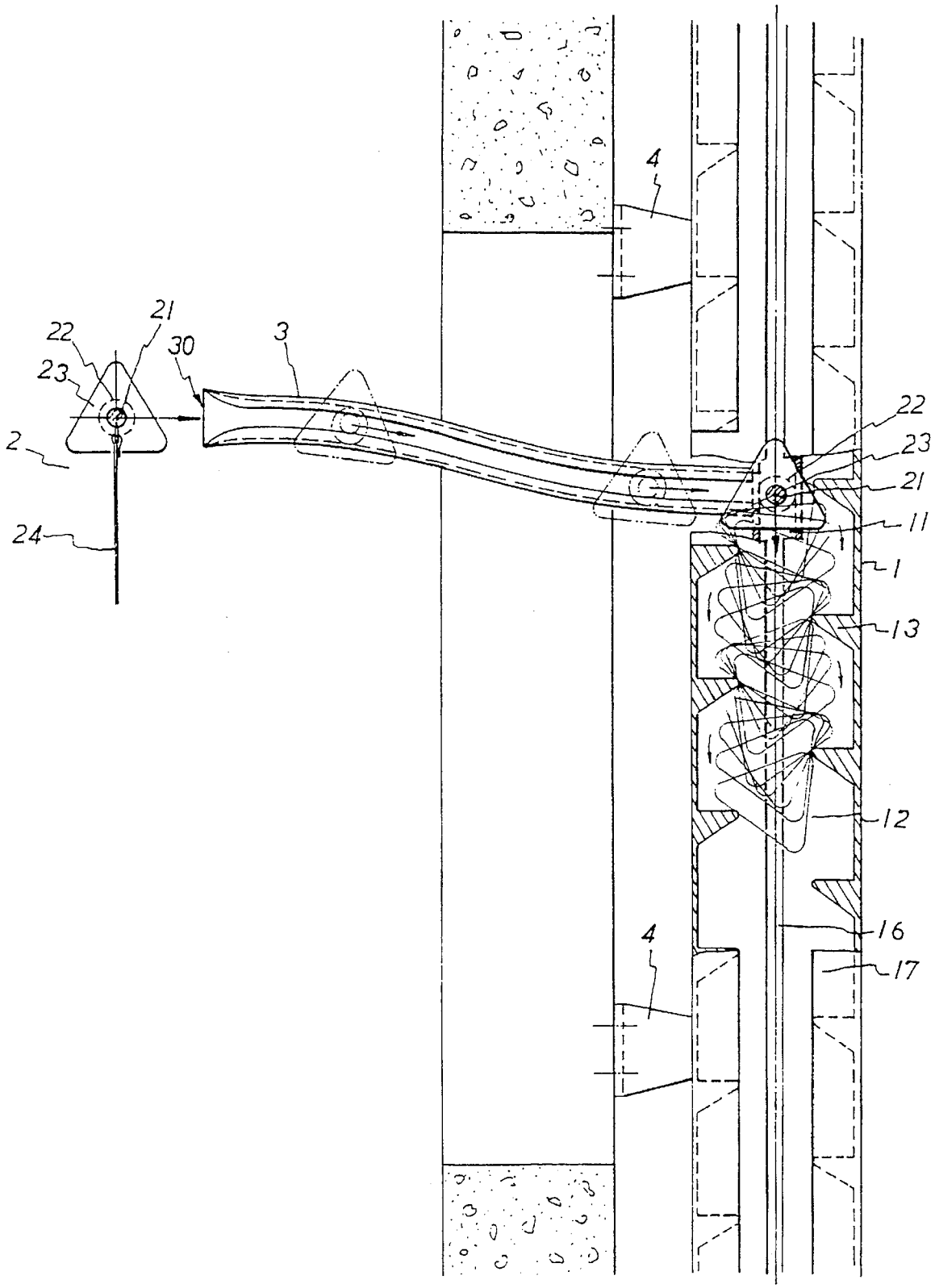
FIG. 2 is a schematic view illustrating the motion of an escape device in an escape slide in accordance with the invention.

Referring to FIGS. 1 and 2, an escape assembly has an escape device 2 and an escape slide. The escape slide has a slip frame 1', a plurality of slide frames 1 and a plurality of slide rail 3.

Figure 3:
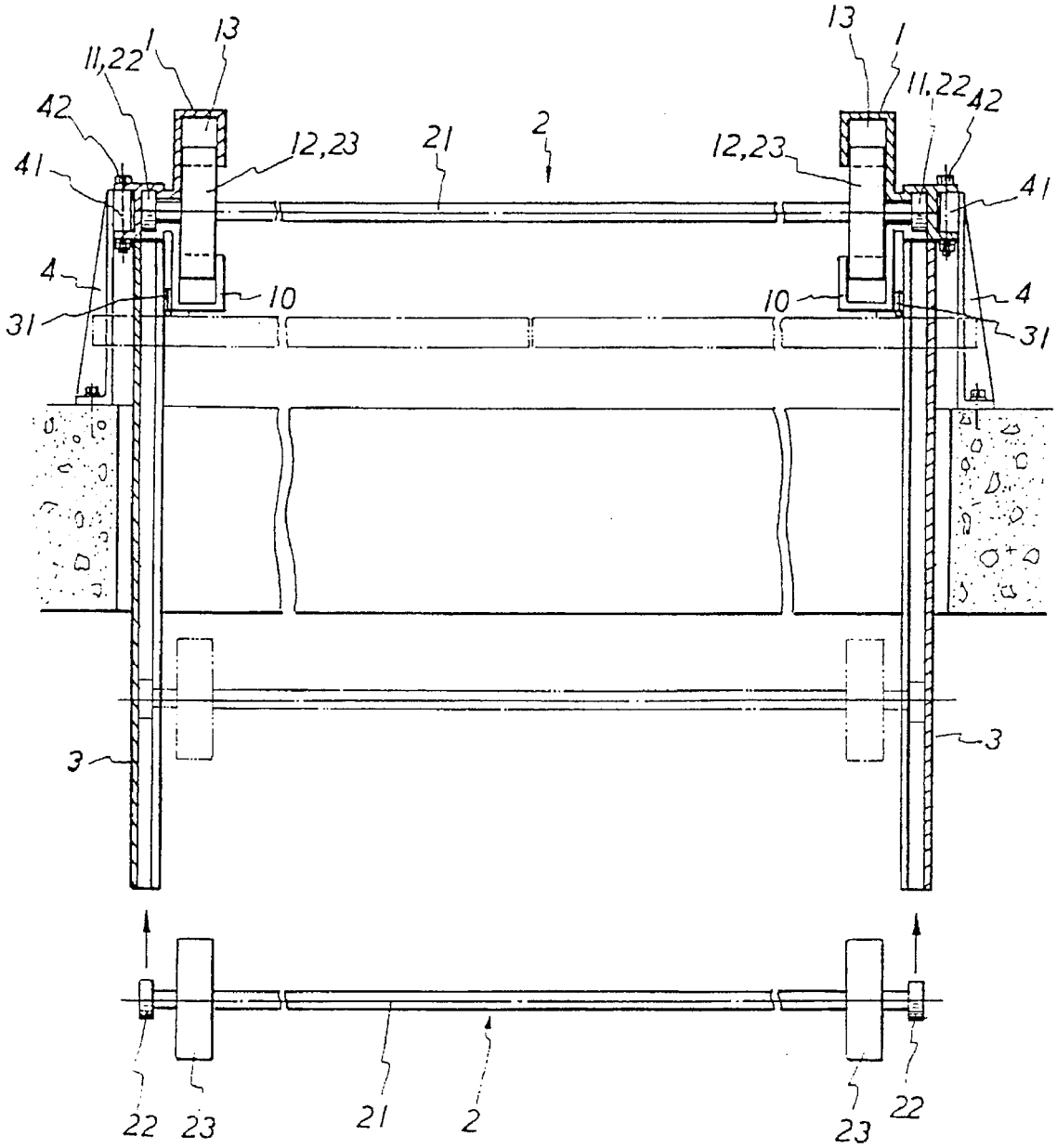
FIG. 3 is a partially sectional view illustrating an escape device in two parallel slide frames and another escape device in two parallel slide rails.
Figure 4:
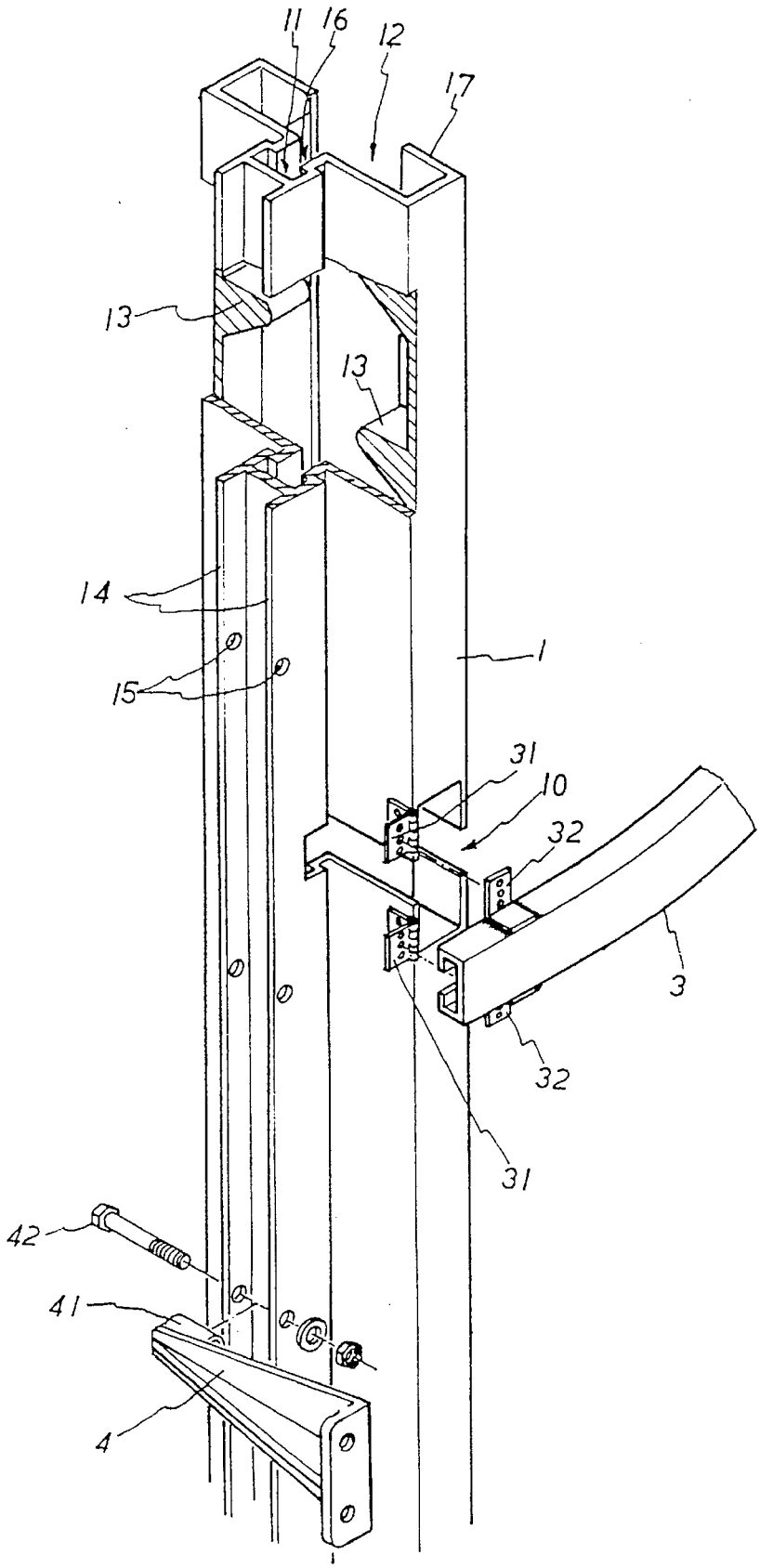
FIG. 4 is a perspective exploded view of a slide frame and a slide rail.

Referring to FIGS. 2 to 4, two rows of parallel slide frames 1 are positioned on an outer wall of a building longitudinally. A curved slip frame 1' connects to each last slide frame 1 of each row of parallel slide frames 1. A generally C-shaped slide rail 3 connects to each slide frame 1 transversely. Each of the slide frames 1 has an H-shaped middle frame 16 connecting to two U-shaped side frames 17. A generally T-shaped recess is defined by the middle frame 16 and the side frames 17. The generally T-shaped recess contains a slide way 11 in the middle frame 16 and a slide passage 12 between the corresponding side frames 17. The middle frame 16 has two parallel positioning plates 14. Each of the side frames 17 has a plurality of spaced retarding blocks 13 therein. Each of the positioning plates 14 has a plurality of spaced positioning holes 15 thereon. Each of the slide frames 1 is positioned by at least a positioning seat 4. The positioning seat 4 has a hollow lug 41 at one end and two round holes at the opposite end of the positioning seat 4. The hollow lug 41 is inserted in the spacing between two parallel positioning plates 14 and fastened by a bolt 42. The positioning seat 4 is fastened on the outer wall of the building via two round holes. One of the two side frames 17 has a notch 10 thereon. Two hinges 31 are disposed at the back of the side frame 17 adjacent to the notch 10. Two angle plates 32 are disposed at one end of the slide rail 3. The angle plates 32 and the corresponding hinges 31 are fastened together, respectively.

Referring to FIGS. 6, 6A, 6B and 7, the curved slip frame 1' has a blocking plate 111' abutting a rubber pad 112' at the distal end of the curved slip frame 1'. The curved slip frame 1' has an H-shaped intermediate frame 16' connecting to two U-shaped lateral frames 17' A plurality of grooves 18' are formed along two inner side peripheries of the intermediate frame 16'. A bow-shaped elastic plate 19' is disposed in the corresponding groove 18'. A generally T-shaped recess is defined by the intermediate frame 16' and the lateral frames 17'. The generally T-shaped recess contains a slip way 11' in the intermediate frame 16' and a slip passage 12' between the corresponding lateral frames 17'. The intermediate frame 16' has two parallel plates 14'.

Figure 5:
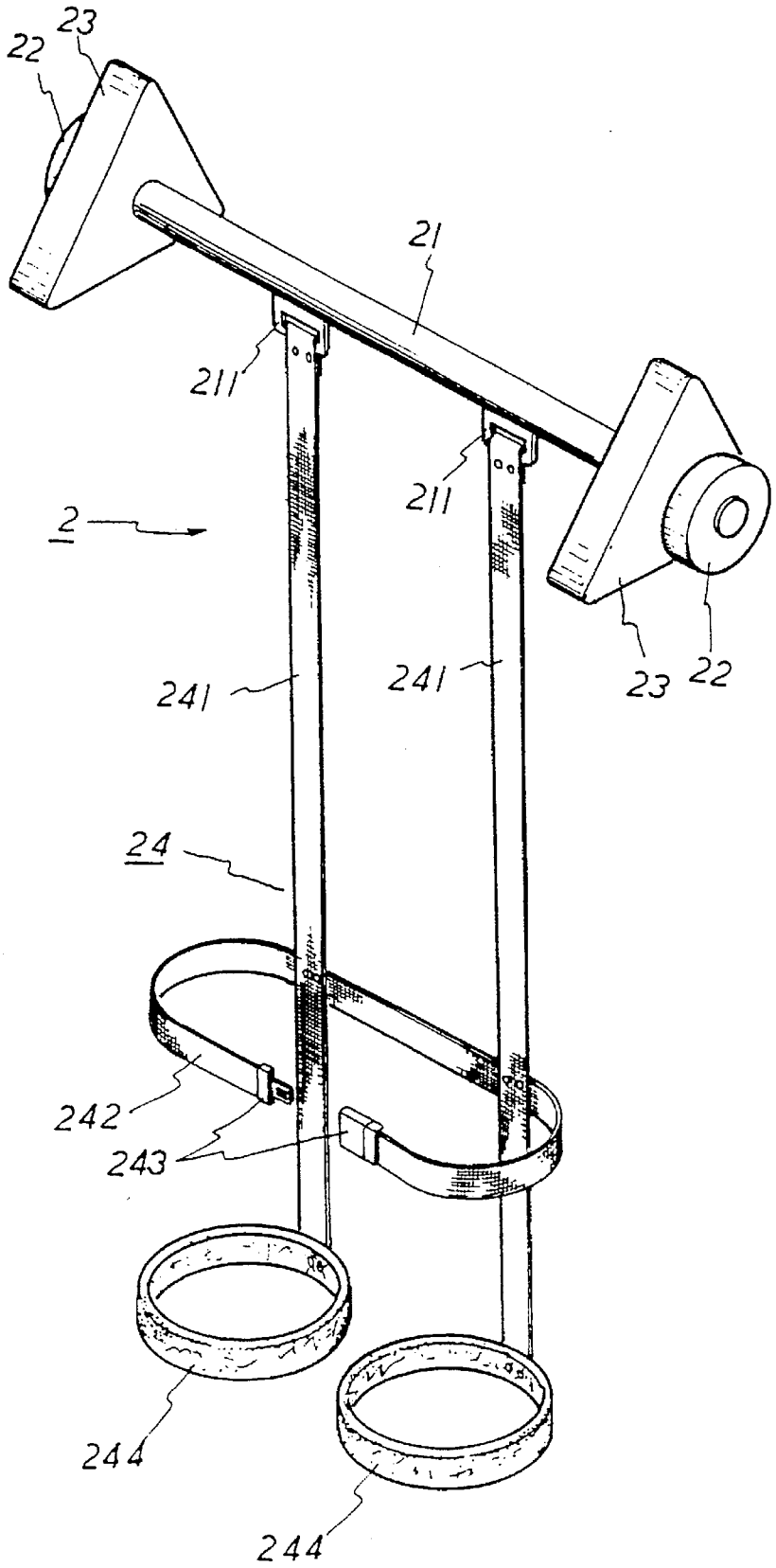
FIG. 5 is a perspective view of an escape device in accordance with the invention.
Figure 6:
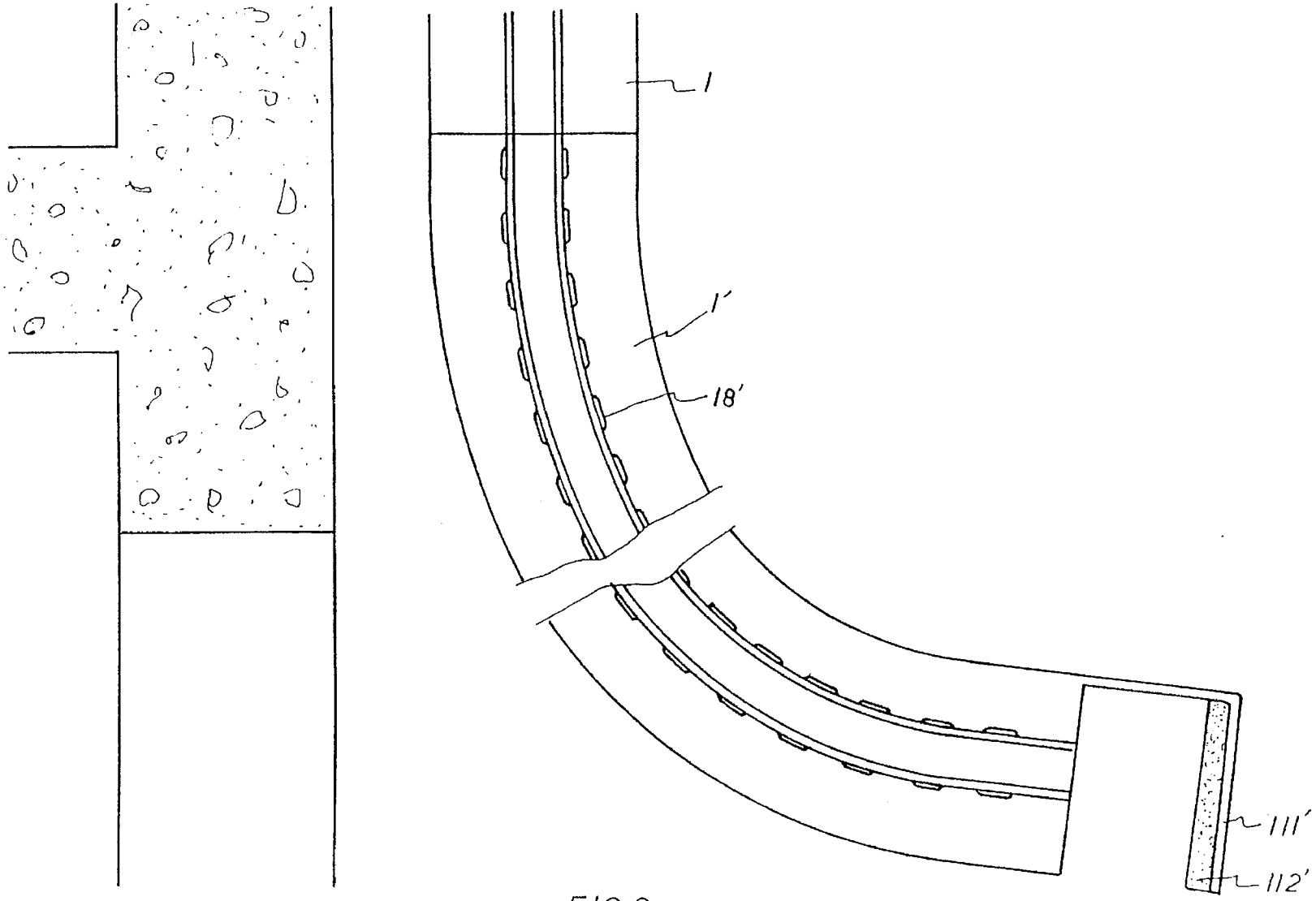
FIG. 6 is a schematic view of a slip frame.
Figure 6A:
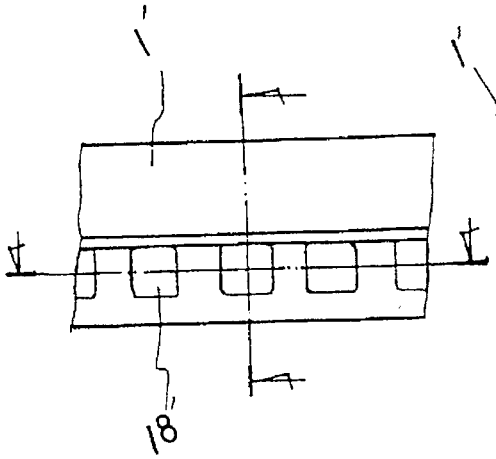
FIG. 6A is a schematic view illustrating a plurality of side grooves in a slip frame.
Figure 6B:
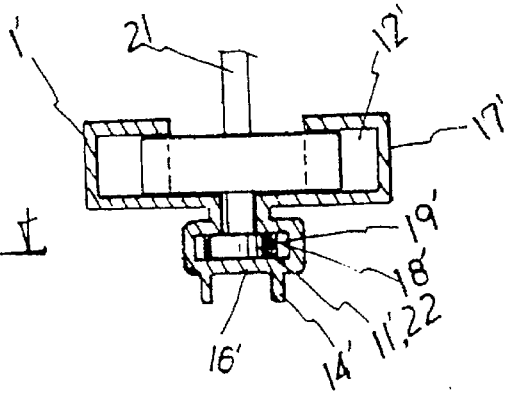
FIG. 6B is a partially sectional view illustrating an escape device in a slip frame.
Figure 7:
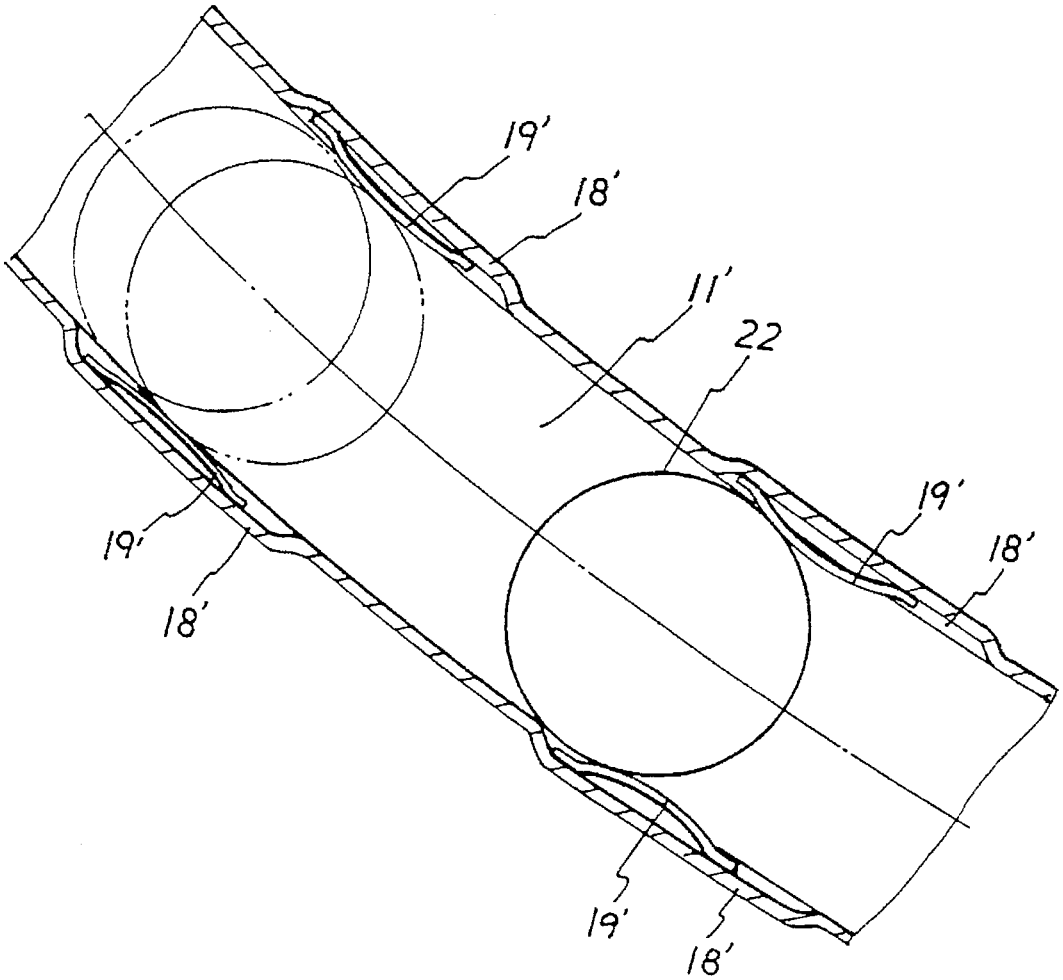
FIG. 7 is a partially sectional view of a slip frame.

Referring to FIGS. 2, 4 and 5, the escape device 2 has a transverse rod 21, two triangular blocks 23, two wheels 22, two parallel longitudinal belts 241, two loops 244 and a transverse belt 242 with a fastening device 243 thereon. Each end of the transverse rod 21 has a wheel 22 abutting a triangular block 23. Two rings 211 are disposed beneath the transverse rod 21. Each ring 211 connects to a longitudinal belt 241 of a safety belt 24. A loop 244 is disposed at a distal end of each longitudinal belt 241. A transverse belt 242 connects two longitudinal belts 241.

Referring to FIGS. 1 to 7 again, each wheel 22 of the escape device 2 is inserted in the slide rail 3 via the opening 30 of the slide rail 3. The legs of the user pass through the corresponding loops 244. Then the fastening device 243 is fastened tightly. The wheels 22 are descended along the corresponding slide ways 11. The triangular blocks 23 are descended along the corresponding slide passages 12. The spaced retarding blocks 13 retard the descent of the escape device 2. The bow-shaped elastic plates 19' retard the descent of the escape device 2 also. The blocking plate 111' and the rubber pad 112' block the escape device 2. Thus the user can reach the ground safely.

The invention is not limited to the above embodiment but various modification thereof may be made. Further, various changes in form and detail may be made without departing from the scope of the invention.

I claim:

1. An escape assembly comprising:

two rows of parallel slide frames positioned on an outer wall longitudinally;

a curved slip frame connecting to a last slide frame of each row of parallel slide frames;

a generally C-shaped slide rail connecting to each of said slide frame transversely;

each of said slide frames having an H-shaped middle frame connecting to two U-shaped side frames, a slide way formed in said middle frame, a slide passage formed between said corresponding side frames, said middle frame having two parallel positioning plates, each of said side frames having a plurality of spaced retarding blocks therein, each of said positioning plates having a plurality of spaced positioning holes thereon, each of said slide frames positioned by at least a positioning seat, said positioning seat having a hollow lug at one end and two round holes at an opposite end of said positioning seat, said hollow lug inserted in a spacing between said parallel positioning plates and fastened by a fastener, said positioning seat fastened on said outer wall, one of said two side frames having a notch thereon, two hinges disposed at a back of said side frame adjacent to said notch, two angle plates disposed at one end of a slide rail, said angle plates and said corresponding hinges fastened together;

said curved slip frame having a blocking plate abutting a rubber pad at a distal end of said curved slip frame, an H-shaped intermediate frame connecting to two U-shaped lateral frames, a plurality of grooves formed along two inner side peripheries of said intermediate frame, an elastic plate disposed in each of said corresponding grooves, a slip way formed in said intermediate frame, a slip passage formed between said corresponding lateral frames, said intermediate frame having two parallel plates;

an escape device having a transverse rod, two triangular blocks, two wheels, two parallel longitudinal belts, two loops and a transverse belt with a fastening device thereon, each end of said transverse rod having a wheel adjacent to a triangular block, two rings disposed beneath said transverse rod, each of said rings connecting to a longitudinal belt, a loop disposed at a distal end of each of said longitudinal belts, a transverse belt connecting said longitudinal belts;

wherein each of said wheels of said escape device is inserted in said slide rail via an opening of said slide rail and descended along said corresponding slide ways, and each of said triangular blocks is descended along said corresponding slide passages.

* * * * *